United States Patent [19]

Hashimoto

[11] 4,299,506

[45] Nov. 10, 1981

[54] MECHANICAL PENCIL

[75] Inventor: Junichi Hashimoto, Saitama, Japan

[73] Assignee: Pentel Kabushiki Kaisha, Tokyo, Japan

[21] Appl. No.: 70,741

[22] Filed: Aug. 29, 1979

[30] Foreign Application Priority Data

| | | | |
|---|---|---|---|
| Aug. 31, 1978 | [JP] | Japan | 53-106459 |
| Oct. 31, 1978 | [JP] | Japan | 53-134119 |
| Nov. 28, 1978 | [JP] | Japan | 53-163668[U] |
| Feb. 14, 1979 | [JP] | Japan | 54-17949[U] |

[51] Int. Cl.[3] ..... B43K 21/08

[52] U.S. Cl. ..... 401/72; 401/195

[58] Field of Search ..... 401/55, 57, 68, 72, 401/69, 71, 75, 79, 195, 57

[56] References Cited

U.S. PATENT DOCUMENTS

| | | | |
|---|---|---|---|
| 1,664,071 | 3/1928 | Furedy | 401/68 X |
| 2,039,466 | 5/1936 | Wahl | 401/72 X |
| 2,184,863 | 12/1939 | Most | 401/55 X |
| 2,504,420 | 4/1950 | Hull et al. | 401/72 X |
| 2,511,243 | 6/1950 | Brubaker | 401/72 |
| 3,997,972 | 12/1976 | Jaunarajs | 401/52 X |
| 4,037,283 | 7/1977 | Moisiuk | 401/195 X |

*Primary Examiner*—Edward M. Coven

*Attorney, Agent, or Firm*—Robert E. Burns; Emmanuel J. Lobato; Bruce L. Adams

[57] ABSTRACT

A mechanical pencil is disclosed which comprises a casing having a ferrule at its tip end and having an axially extending central bore formed therein, and a lead-containing sleeve fitted into the central bore and capable of containing a plurality of leads. The mechanical pencil includes a lead guide pipe which is mounted in the ferrule and extending into the central bore. A feed roller is rotatably mounted within the central bore between the lead guide pipe and the lead-containing sleeve for feeding a lead from the sleeve into the lead guide pipe. The feed roller has a frusto-conical configuration with its axis disposed at an angle with respect to the axis of the central bore, and is peripherally provided with a helical rib, which is adapted to engage the periphery of lead. A rotation is externally imparted to the shaft of the feed roller, thereby rotating it to feed a given length of the lead forward.

13 Claims, 22 Drawing Figures

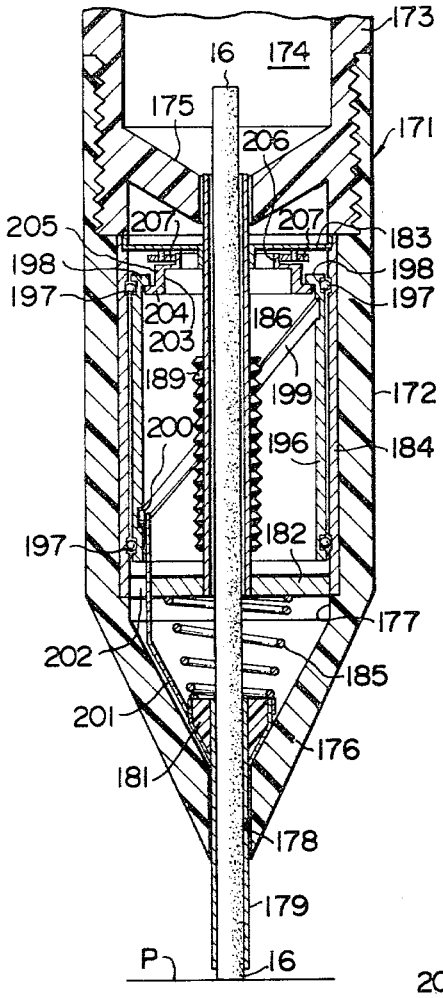
FIG. 15
FIG. 16
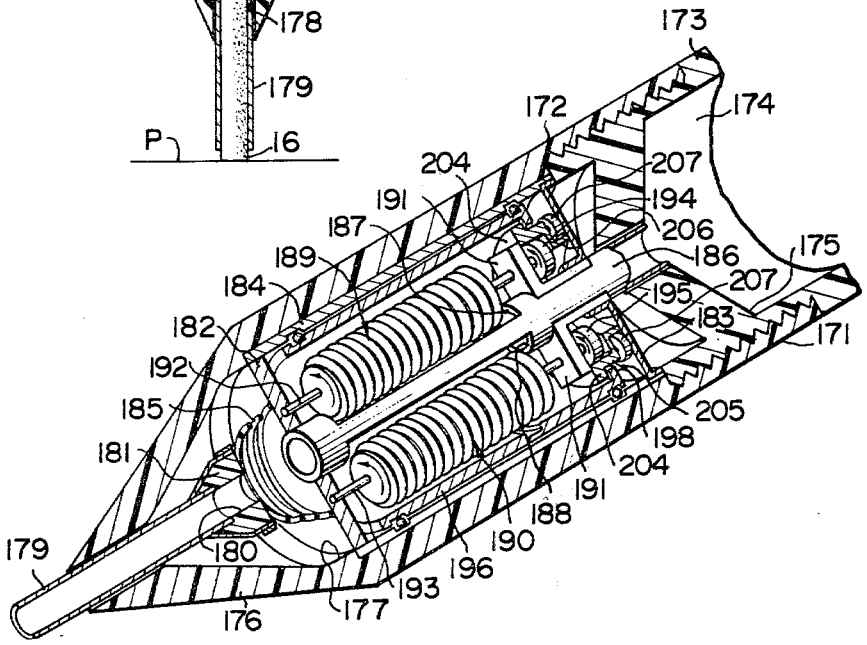

MECHANICAL PENCIL

FIELD OF THE INVENTION

The invention relates to a mechanical pencil, and more particularly, to a lead feed mechanism of a mechanical pencil in which the advance or retraction of a lead is controlled by the rotation of a lead feed roller which extends substantially parallel to the lead toward the tip end within a casing and having a helical rib formed around its periphery which is adapted to engage the lead.

DESCRIPTION OF THE PRIOR ART

Generally, mechanical pencils are categorized into two types, a rotation fed type and a push fed type, depending on the manner in which the lead is fed. Mechanical pencils of a rotation fed type are disclosed in U.S. Pat. No. 2,722,913 issued to Joseph Aversa on Nov. 8, 1955 and U.S. Pat. No. 3,477,791 issued to Nagahiro Yamashita on Nov. 11, 1969 and assigned to the common assignee as the present application. These mechanical pencils include a casing formed by a pair of coaxially disposed members having an axially extending central bore, a guide pipe disposed within the casing and peripherally formed with a helical slit and which can be rotated within one of the members as the other member is rotated, and a holder pipe loosely fitted inside the guide pipe and having its one end receiving one end of a lead to hold it frictionally. The holder pipe is formed with a projection on its outer periphery which engages with the slit formed in the guide pipe and which also engages a slot formed axially in the inner wall of said one member, whereby the holder pipe is supported against rotation while permitting its axial translation. As the guide pipe rotates, the holder pipe which has its projection engaged with the helical slit in the guide pipe moves axially to permit the lead to project from the tip of the casing or retracted therefrom in accordance with the direction in which the guide pipe is rotated. On the other hand, mechanical pencils of a push fed type are disclosed in U.S. Pat. No. 3,627,434 issued to Yukio Horie on Dec. 14, 1969 and assigned to the common assignee as the present application, for example. Such pencil comprises a collet chuck which is disposed so as to be axially movable within a cylindrical casing and holding a lead, a lead containing sleeve which has its one end connected with the collet chuck and its other end projecting from the rear end of the casing, and spring means which normally urges the lead containing sleeve toward the rear end of the casing. The lead is advanced by pushing the rear end of the lead containing sleeve toward its front end. Specifically, as the sleeve is pushed, the collet chuck moves toward the front end of the casing while carrying the lead, and as it advances through a given distance, the chuck is opened, whereupon the lead is held stationary at its advanced position. When the rear end of the lead containing sleeve is released, the resilience of the spring means returns the sleeve to its original position, whereby the collet chuck returns to its original position while maintaining its open position to catch another lead again.

With a mechanical pencil of rotation fed type, the amount of a rotation can be adjusted to feed a controlled length of lead. However, because the lead must be inserted into one end of the holder pipe one by one, it is necessary to insert a fresh lead into the holder pipe whenever a lead is completely used. By contrast, the collet chuck and the lead containing sleeve are connected together in a mechanical pencil of push fed type, so that when a lead is completely used, a fresh lead is successively fed into the collet chuck from the sleeve. Hence, it is unnecessary to insert a fresh lead when a lead is completely used as it is required with a mechanical pencil of rotation fed type. However, the length of lead which is fed by a single push operation is predetermined, it is impossible to feed forward a controlled length of lead which is desired by a user.

SUMMARY OF THE INVENTION

It is an object of the invention to provide a mechanical pencil which permits a desired length of lead to be fed forward and in which a pencil lead can be successively fed into the operative position whenever the previous lead is completely used.

In accordance with the invention, there is provided a mechanical pencil comprising a casing having a ferrule at its one end and having a central bore which extends axially thereof, a lead-containing sleeve capable of containing a plurality of leads, the sleeve being adapted to be fitted into the central bore and having its rear end closed by a cover which is detachably mounted on the casing, the front end of the sleeve being narrowed while leaving an opening in alignment with the axis thereof which has a diameter slightly greater than that of the lead, a lead guide pipe mounted in the ferrule so as to be aligned with the axis of the central bore and slidably holding the lead, lead feed means located intermediate the lead guide pipe and the lead-containing sleeve and including at least one lead feed roller having a helical rib on its periphery for engagement with the outer peripheral surface of the lead, drive means for rotating the lead feed roller about its axis, and operating means mounted on the outside of the casing for operating the drive means.

In a preferred embodiment of the invention, a rear casing which forms the rear end portion of the casing is disposed rotatable about the axis of the central bore while the rear end of the lead-containing sleeve is mounted for rotation in ganged relationship with the rotation of the rear casing. The lead feed means comprises a first and a second feed roller, each of which is disposed on the opposite sides of the axis of the central bore to hold the lead therebetween as it is fed into the nip therebetween. The front end of the lead containing sleeve is peripherally formed with annular rack teeth, which mesh with drive gears mounted on the shafts associated with the respective feed rollers. Consequently, as the rear casing is rotated, the rack teeth on the sleeve rotate, whereby the pair of feed rollers rotate in the same direction as they are driven through the drive gears which mesh with the rack teeth. By regulating the rotation of the operating means, a desired length of lead can be fed through the front end of the lead guide. When a lead is completely used, a fresh lead can be fed into the nip between the lead feed rollers from the lead containing sleeve.

In another preferred embodiment of the invention, the lead feed means comprises three feed rollers, one of which is formed with a helical rib which proceeds in the opposite direction from the helical ribs on the remaining two rollers, and hence rotates in the opposite direction from the latter. This prevents a rotation of the lead itself as it is being fed. The drive means may comprise a motor, and a reduction gearing connected with a drive shaft of the motor. In this instance, the operating means may comprise a switch arrangement which is operated to establish a forward or reverse rotation of the motor.

BRIEF DESCRIPTION OF DRAWINGS

FIG. 15 is a longitudinal section of a lead feed mechanism according to an eleventh embodiment of the invention;

FIG. 16 is a perspective view, partly in section, of the lead feed mechanism shown in FIG. 15;

DESCRIPTION OF PREFERRED EMBODIMENTS

Figure 1:
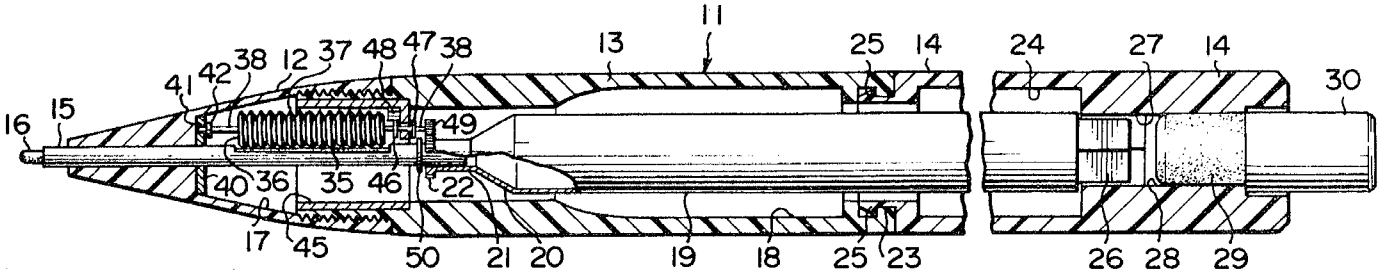
FIG. 1 is a longitudinal section, partly broken away, of a mechanical pencil according to a first embodiment of the invention.

Referring to the drawings, several embodiments of the invention will now be described, and it is to be understood that corresponding parts are designated by like reference numerals throughout the drawings.

Figure 2:
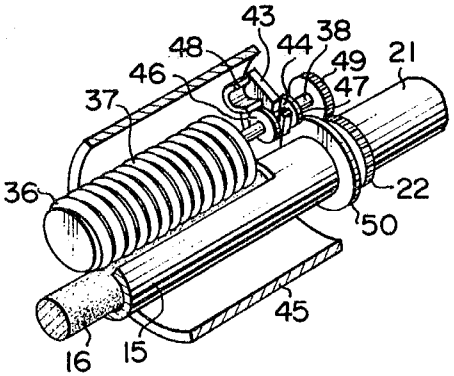
FIG. 2 is a perspective view showing a lead feed mechanism of FIG. 1.

Initially referring to FIGS. 1 and 2, there is shown a first embodiment of the invention. An external casing generally designated by reference numeral 11 includes a front casing 12 which is located foremost and having its front end formed into a tapered ferrule, an intermediate casing 13 having its front end threadably engaged with the rear end of the front casing 12, and a rear casing 14 which has its front end fitted into the rear end of the intermediate casing 13 by snap action. The various parts of the external casing 11 are molded from a synthetic resin material. The front casing 12 houses a tubular lead guide 15 extending axially in alignment with the axis thereof and which is fixedly carried by the front portion of the front casing 12. The front end of the lead guide 15 slightly projects beyond the front end of the casing 12 while its other end or rear end is located within the intermediate casing 13. Lead guide 15 is formed of a metal material, and slidably supports a lead 16 within its bore. Toward its rear end, the front casing 12 is internally provided with a cavity 17 which is concentric with the lead guide 15. A cavity 18 is formed inside the intermediate casing 13 and extends axially to communicate with the cavity 17. An open-ended lead-containing pipe 19 having a greater diameter than the lead guide 15 is disposed axially within the cavity 18, and is formed of a metal material. The purpose of the pipe 19 is to contain spare leads 16 therein. The front portion of the pipe 19 is formed with a front conical surface 20 and a fitting portion 21 which extends horizontally from the front end of the conical surface 20. The fitting portion 21 has an internal diameter which is slightly greater than the outer diameter of the lead guide 15 so as to be loosely fitted over the rear end of the lead guide 15. On its front end, the fitting portion 21 is peripherally formed with rack teeth 22. On its rear end, the intermediate casing 13 is internally formed with a pair of annular rims 23 which extend radially inward. On its front end, the rear casing 14 is internally formed with a hook-shaped projection 25 which extends over the rearmost rim 23 on the intermediate casing 12 to fit between the rims 23 thereon. By fitting the projection 25 on the rear portion of the intermediate casing 13, the rear casing 14 can be connected with the intermediate casing 13 in a rotatable manner. A cavity 24 is formed within the rear casing 14 and communicates with the cavity 18, the rear portion of the pipe 19 extending into the cavity 24. The rear end 26 of the pipe 19 is shaped to present a rectangular cross section so as to be fitted into a rectangular opening 29 formed in the rear end of the cavity 24, whereby a rotation of the rear casing 14 is positively transmitted to the lead containing pipe 19 to rotate it. The rear end of the rectangular opening 29 communicates with a circular opening 28 which opens into the rear end face of the rear casing 14. In the example shown, an eraser such as india-rubber 29 is detachably fitted into the opening 28. The rear end of the eraser 29 is fixed to a protective cap 30, which can be gripped between fingers to remove the eraser 29. This permits spare leads to be supplied into the pipe 19.

Considering now the lead feed mechanism, an axially extending notch 35 having a relatively increased length is formed in the upper portion of the lead guide 15 in its region extending from the opening 17 in the front casing to the cavity 18 of the intermediate casing 13. An axially extending feed roller 36 is disposed parallel to the axis of the lead guide 15 for engagement with the periphery of the lead 16 which is exposed through notch 35. The feed roller 36 is peripherally formed with a continuous helical rib 37 which is formed in the manner of a left-hand screw. The feed roller 36 is formed of a metal material such as aluminum or brass or a synthetic resin such as acrylic, polycarbonate or butadienne copolymer resin (ABS). The feed roller 36 is provided with support shafts 38 which extend from its opposite ends. The front shaft 38 is received in an opening 41 formed in a support plate 40 which is rotatably disposed within the front end of the cavity 17. A movement of the front shaft 38 in the forward direction is limited by a stop ring 42 which is fixedly mounted on the shaft 38. The rear shaft 38 is received in a slit 44 formed in a holding plate 43. The slit 44 (see FIG. 2) is formed so as to permit movement of the associated shaft 38 toward the axis of the lead 16. The upper end of the holding plate 43 is secured to the internal surface of a cylindrical body 45 at its rear end which is fitted into and secured to the front end of the cavity 18 of the intermediate casing 13. A pair of stop rings 46, 47 are mounted on the rear shaft 38 so as to hold the plate 43 therebetween. The stop ring 46 engages one limb of a substantially U-shaped leaf spring 48 which has its other limb secured to the internal surface of the cylindrical body 45. The leaf spring 48 resiliently urges the rear top shaft downward, i.e. toward the axis of the lead guide 15. It should be understood that the leaf spring may be replaced by any other resilient bias member. A pinion 49 is mounted on the rear end of the rear shaft 38 for meshing engagement with the rack teeth 22 formed on the lead-containing pipe 19. A stop rib 50 is mounted on the lead guide 15 to limit a movement of the pipe 19 in the axially forward direction.

In operation, the rear casing 14 is rotated counter-clockwise while the foremost end of the front casing 12 is directed downward. This rotation is transmitted through the rear end 16 of the pipe 19 which is fitted into the rectangular opening 27 in the rear casing 14 in a positive manner, thus causing a counter-clockwise rotation of the pipe 19. Such rotation of the pipe 19 is transmitted to the pinion 49 through the rack teeth 22, whereby the pinion 49, and hence the feed roller 36, rotates clockwise. When the rib 37 on the feed roller 36 is helically formed in the manner of a left-hand screw, the helix will move to the left, as viewed in FIG. 1. On the other hand, one of the leads 16 contained in the pipe 19 will slide along the front conical surface 20 to be dropped into the lead guide 15 where it will be engaged by the rear end of the feed roller 36. It is to be noted that both axial ends of the feed roller 36 have a reduced diameter as is usually found in a screw, so that the leading end of the lead 16 is initially engaged by such portion of the feed roller 36 having a reduced diameter, allowing the outer end of the rib 37 to bite lightly into the outer periphery of the lead 16. Once such biting action occurs, the lead 16 causes the feed roller 36 to be driven outward, or upward as viewed in FIG. 1, against the resilience of the leaf spring 48. Subsequently, a clockwise rotation of the feed roller 36 enables the lead 16 to move down, or to the left as viewed in FIG. 1. A cut of a small depth is formed in the periphery of the lead 16 by the rib 37. The cut progresses in the opposite direction from the rib 37, namely, in the manner of a right-hand screw in the present example, thus enabling a positively controlled movement of the lead 16 to the left. After the rib 37 on the feed roller 36 has engaged the lead 16, a continued rotation of the rear casing causes the lead 16 to advance further forward, whereby the leading end of the lead 16 projects beyond the front end of the lead guide 15. Because the leaf spring 48 maintains the feed roller 36 in abutment against the periphery of the lead 16, a retraction of the lead 16, namely, its movement to the right, as viewed in FIG. 1, during the writing process is prevented. When it is desired to retract the lead 16, the rear casing 14 may be rotated clockwise. The clockwise rotation of the casing 14 causes a counter-clockwise rotation of the feed roller 36, whereby the lead 16 is moved to the right, as viewed in FIG. 1. When the initial lead 16 is completely used as a result of a writing process, another spare lead contained in the pipe 19 is successively fed into the lead guide 15.

The amount through which the lead 16 is fed forward is determined by the pitch of the feed roller 36 and the turn ratio of the rack teeth 22 and the pinion 49. By way of example, when the feed roller 36 has a pitch of 0.4 mm and one revolution of the rack 22 permit three revolutions of the pinion 49, a rotation of the rear casing 14 through one-third revolution causes the lead to be fed forward 0.4 mm. It is to be noted that the amount of feed can be controlled continuously, so that it is a simple matter to feed forward a desired length of the lead by adjusting the amount of rotation of the rear casing 14. In this embodiment, the helical rib 37 on the feed roller 36 is formed in the manner of a left-hand screw, so that a counter-clockwise rotation of the rear casing 14 feeds the lead 16 forward. However, when the rib on the feed roller is formed in the manner of a right-hand screw, the rear casing may be rotated in clockwise to feed the lead forward.

Figure 3:
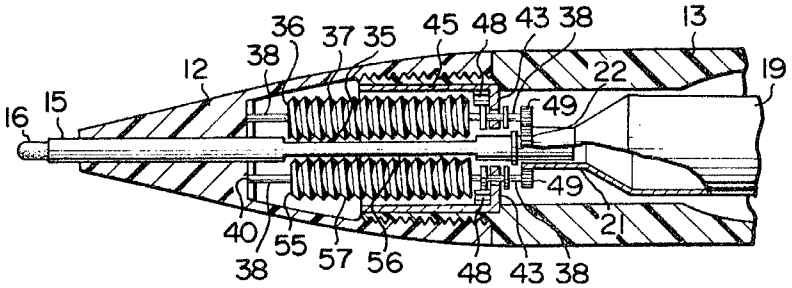
FIG. 3 is a longitudinal section of a lead feed mechanism according to a second embodiment of the invention.

Referring to FIG. 3, there is shown a second embodiment of the invention in which an additional feed roller 55 is provided. The two feed rollers 36, 55 are disposed to hold the lead 16 therebetween while feeding it forward. Specifically, the second feed roller 55 is disposed parallel to the feed roller 36 at an angular position which is 180° spaced from the feed roller 36 relative to the axis of the lead guide 15. The lead guide 15 is additionally formed with a second notch 56 which is 180° spaced from the first mentioned notch 35 to expose the part of the lead 16 therethrough. A helical rib 57 is formed on the periphery of the second feed roller 55 in the manner of a left-hand screw in the same manner as the feed roller 36, whereby the rib 57 is adapted to engage the peripheral surface of the lead 16 which is exposed through the second notch 56. The support of and a rotation transmission mechanism for the second feed roller 55 are similar to those described above in connection with the first embodiment, and therefore will not be described specifically.

In operation, when the rear casing 14 (FIG. 1) is rotated counter-clockwise, the lead-containing pipe 19 also rotates in the same direction. The rotation of the pipe 19 causes the two pinions 49 to rotate clockwise, advancing the lead 16 to the left, as viewed in FIG. 3. A smooth feeding operation for the lead 16 is assured by holding the lead 16 between the two feed rollers 36, 55. Because the lead 16 is urged in two directions, the grip on the lead 16 as well as the force to feed the lead 16 by the rollers 36, 55 can be increased.

Figure 4:
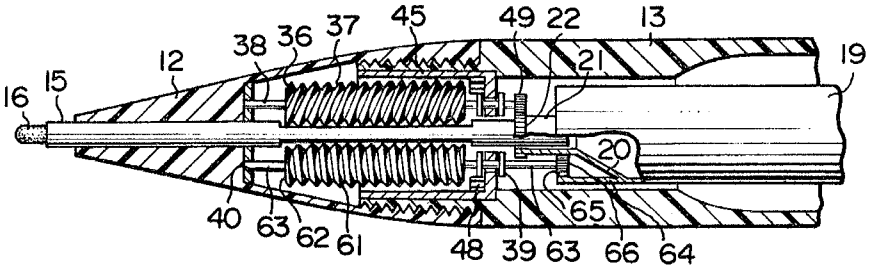
FIG. 4 is a longitudinal section of a lead feed mechanism according to a third embodiment of the invention.

In an embodiment shown in FIG. 4, the second feed roller 55 of the second embodiment is replaced by a reversing roller 62 having a helical rib 61 which proceeds in the opposite direction. Specifically, the rib 61 on the reversing roller 62 is formed in the opposite direction from the rib on the feed roller 36, that is to say, in the manner of a right-hand screw. The reversing roller 62 carries a rear support shaft 63 which extends through the holding plate 43 to the rear side thereof. The lead-containing pipe 19 is formed with an extension 64 which extends parallel to the axis thereof so as to cover the front conical surface 20 thereof. On its front end, the extension ring 64 is internally formed with annular rack teeth 65, which mesh with a pinion 66 mounted on the rear end of the rear shaft 63. The standard pitch circle of the rack teeth 65 has a diameter which is twice the diameter of the standard pitch circle of the rack teeth 22, so that the feed roller 37 is formed as double-threaded screw in order to increase the pitch of the feed roller 37 will be twice the pitch of the reversing roller 62.

In the operation of this third embodiment, when the rear casing 14 is rotated counter-clockwise, the pinion 49 rotates clockwise in the same manner as in the previous embodiment. On the other hand, the pinion 66 rotates counter-clockwise as a result of its meshing engagement with the rack teeth 65 on the extension ring 64. Consequently, the feed roller 36 and the reversing roller 62 rotate in the opposite direction. Though the reversing roller 62 rotates in the opposite direction, the rib 61 formed thereon in the manner of a right-hand screw permits the lead 16 to be fed to the left, as viewed in FIG. 3. Consequently, the two rollers 36, 62 feed the lead 16 forward while firmly holding it therebetween. The rotation of the pair of rollers 36, 62 in the opposite directions permits the lead 16 to be fed forward without causing its rotation.

Figure 5:
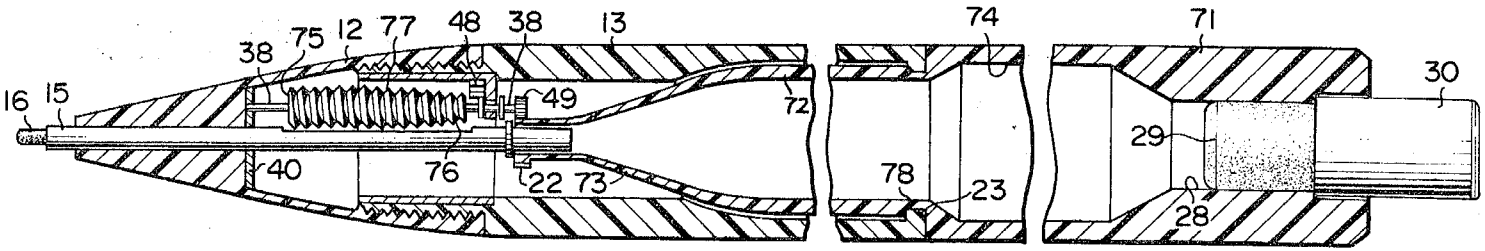
FIG. 5 is a longitudinal section, partly broken away, of a fourth embodiment of the invention.

FIG. 5 shows a fourth embodiment of the invention in which the lead-containing pipe is formed integrally with the rear casing and an initial engagement between the feed roller and the lead is assured. Specifically, a rear casing 71 includes a cylindrical extension 72 which extends into the cavity 18 of the intermediate casing 13, with the front portion of the extension 72 being formed into a front conical portion 73. At its opposite end, the extension 72 is peripherally formed with an annular groove 78 in which the annular rim 25 formed on the rear end of the intermediate casing 13 is fitted, thus allowing a rotation of the rear casing 71 relative to the intermediate casing 13. The rear end of the lead guide 15 is fitted into the front end of the conical portion 73 so as to be supported thereby. Rack teeth 22 are formed on the outer periphery of the front portion of the conical portion 73 for meshing engagement with the pinion 49. In this manner, a cavity 74 of the rear casing 71 can be utilized for containing spare leads, allowing an increased number of leads 16 to be contained therein as compared with a separate lead-containing pipe 19 which has been used in the previous embodiments. In addition, the construction is simplified. Furthermore, a feed roller 75 of this embodiment includes a tapered portion 76 of a diameter which gradually decreases toward its rear end, and a helical rib 77 is formed over the length of the roller 75 from its tapered portion 76 to its front end. Consequently, a lead 16 which is supplied from the cavity 74 within the rear casing 71 is initially engaged by the tapered portion 76 of the feed roller, assuring a smooth initial engagement between the leading end of the lead 16 and the feed roller 75.

Figure 6:
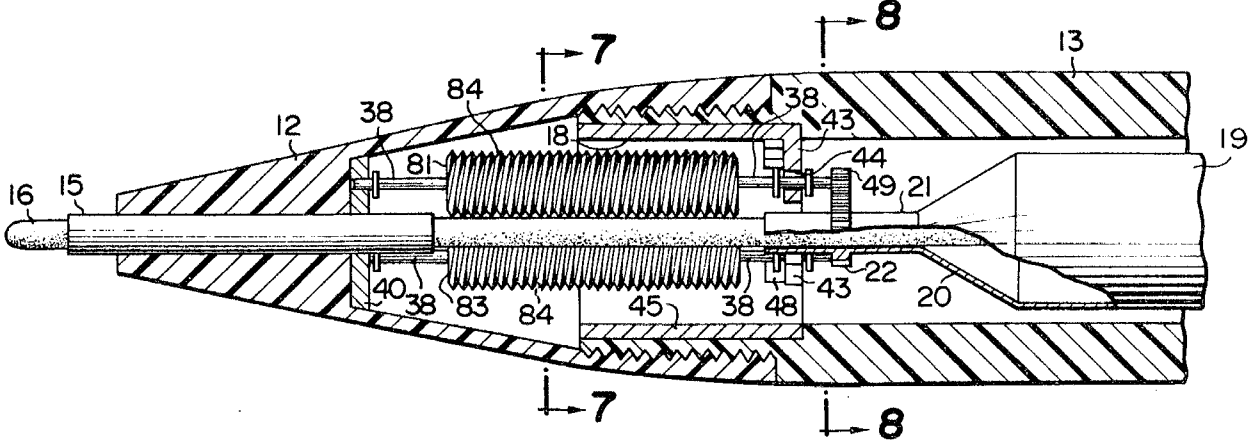
FIG. 6 is a longitudinal section of a lead feed mechanism according to a fifth embodiment of the invention.
Figure 8:
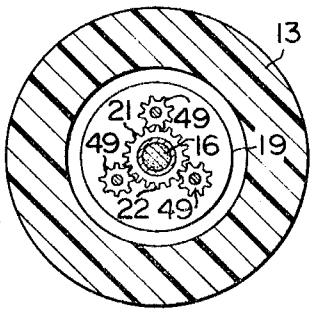
FIG. 8 is a transverse section taken along the line 8—8 shown in FIG. 6.
Figure 7:
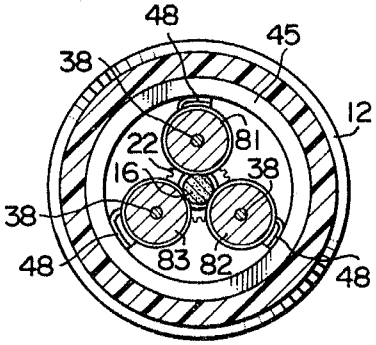
FIG. 7 is a transverse section taken along the line 7—7 shown in FIG. 6.

FIGS. 6 to 8 show a fifth embodiment of the invention in which three feed rollers are employed to feed a lead forward. Specifically, three feed rollers 81, 82, 83, each of which is constructed in the same as manner the feed roller shown in connection with the first embodiment, are spaced apart at an equal angular interval of 120° about the axis of the cavity 18 formed in the intermediate casing 13 so as to surround the lead 16. It will be noted that only two rollers are shown in FIG. 6. A helical rib 84 formed on each roller proceeds in the same direction, that is, is formed as a left-hand screw. The manner in which the individual rollers 81, 82, 83 are supported, and the transmission mechanism by which a rotating drive is transmitted thereto remain the same as those mentioned above in connection with the feed roller 36 of the first embodiment, and therefore will not be specifically described. As shown, the lead 16 is supported by three feed rollers 81, 82, 83, so that the rear end of the lead guide 15 need not extend to the fitting portion 21 of the lead containing pipe 19. Instead, the rear end of the lead guide 15 is located close to the front end of the feed rollers 81 to 83. On the other hand, the fitting portion 21 of the lead containing pipe 19 has an internal diameter which is substantially equal to the internal diameter of the lead guide 15.

As a lead 16 is fed forward from the fitting portion 21 of the pipe 19, it is surrounded by three feed rollers 81 to 83, so that when the pipe 19 is rotated, the three feed rollers 81 to 83 engage the outer periphery of the lead 16 while rotating. Thereupon, the lead 16 is advanced axially forward while slightly spreading the rollers 81 to 83 outward against the resilience of the leaf spring 48. While the lead guide 15 is spaced from the lead-containing sleeve 19 in the present embodiment, the lead cannot move away from any of the rollers because it is surrounded by three rollers.

Figure 9:
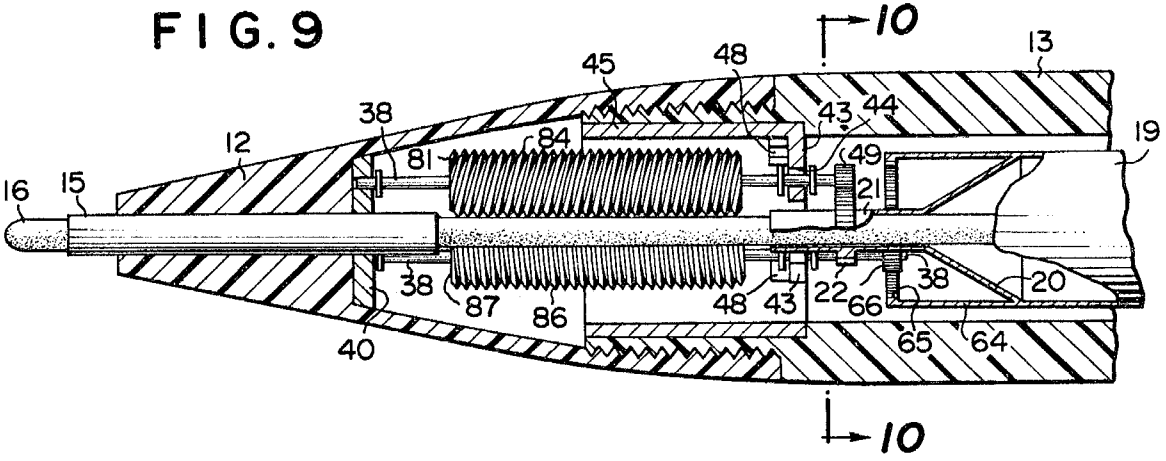
FIG. 9 is a longitudinal section of a lead feed mechanism according to a sixth embodiment of the invention.
Figure 10:
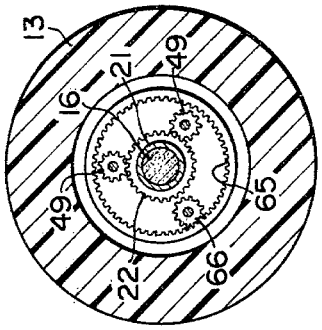
FIG. 10 is a transverse section taken along the line 10—10 shown in FIG. 9.

FIGS. 9 and 10 show a sixth embodiment of the invention where one of the three feed rollers shown in the fifth embodiment is replaced by a reversing roller which has been described above in connection with the third embodiment. Specifically, the feed roller 83 of the fifth embodiment is replaced by a reversing roller 87 having a helical rib 86 which proceeds in the opposite direction. The configuration of the reversing roller 87 and a mechanism which transmits rotation thereto are constructed in the same as the reversing roller 62 described above, and hence will not be described specifically. As before, this arrangement prevents a rotation of the lead 16.

In the fifth and the sixth embodiments, there have been provided three feed rollers. However, it should be understood that four feed rollers may be disposed at an equal angular interval of 90° about the axis of the cavity 18 of the intermediate casing 13. In this instance, two of these rollers may be formed by reversing rollers as illustrated in the third and the sixth embodiments. By increasing the number of feed rollers, the area of contact between the feed rollers and the lead increases, increasing the grip of the feed rollers on the lead.

Figure 11:
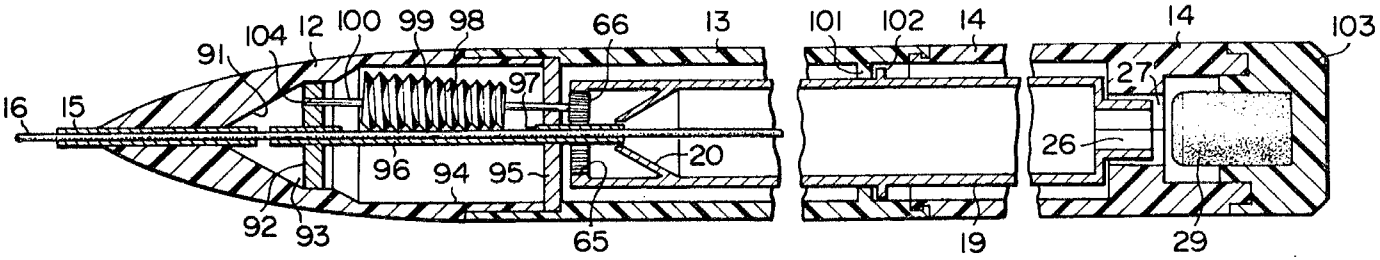
FIG. 11 is a longitudinal section, partly broken away, of a seventh embodiment of the invention.

FIG. 11 shows a seventh embodiment of the invention. In this embodiment, the feed roller is frusto-conical in configuration and has an axis which is disposed at an angle with respect to the axis of the lead guide in a plane which includes the latter. The feed roller is disposed so as to be movable in the axial direction so that the grip on the lead can be varied in accordance with the magnitude of the writing pressure.

Specifically, referring to FIG. 11, the lead guide 15 extends through the front portion of the front casing 12, and has its rear end located within a conical opening 91 formed in the front casing 12. The axis of the conical opening 91 coincides with the axis of the lead guide 15, with its apex located nearer the front end of the lead guide 15. Also formed in the front casing 12 are a support opening 93 which communicates with the rear end of the conical opening 91 and in which a front support plate 92 having its peripheral surface extending parallel to the axis of the lead guide 15 is rotatably fitted, and a roller opening 94 having a greater diameter than the support opening 93. The rear end of the roller opening 94 is closed by a rear support plate 95, which is threadably engaged with the front end of the intermediate casing 13 together with the rear end of the front casing 12. A lead support pipe 96 extends through the front and the rear support plates 92, 95 in aligned relationship with the axes of these support plates. An axially extending notch 97 is formed in the upper surface of the lead support pipe 96. The front end of the lead support pipe 96 is spaced from the rear end of the lead guide 15 while the rear end of the pipe 96 is located in a forward portion of the front conical portion 22 of the lead-containing pipe 19. Consequently, a lead 16 can be fed from the lead-containing pipe 19 through the lead support pipe 96 into the lead guide 15. A feed roller 98 is located above the notch 97 in the lead support pipe 96, and is disposed so that its peripheral surface engages the peripheral surface of the lead 16 which is exposed through the notch 97. As shown, the feed roller 98 is in the form of a frustum of a cone which increases in diameter from its rear end toward its front end. A helical rib 99 is formed on the peripheral surface of the feed roller 98 in the manner of a right-hand screw. The feed roller 98 carries support shafts 100 which are disposed at an angle with the axis of the lead support pipe 96 in a plane which includes the latter axis. It will be noted that the opposite ends of the support shafts 100 are carried by the front and the rear support plates 92, 95 in a manner such that they can be slightly moved along their axes to permit the feed roller 98 to bite into the lead as a writing pressure is applied thereto, as will be further described later. At this end, the front support plate 92 is formed with a support cavity 104 which is provided to support the front support shaft 100 and which has a length to permit a movement thereof. A gear 66 is mounted on the rear support shaft 100 for meshing engagement with the internal rack teeth 65 on the extension ring 64 of the lead-containing pipe 19, in the same manner as described above in connection with the fourth embodiment. Thus, the feed roller 98 is constructed in the same manner as the reversing roller shown in the fourth and sixth embodiments. However, in the present embodiment, the intermediate casing 13 is internally formed with an annular projection 101 toward its rear end which projects radially inward for engagement with a detent projection 102 which is formed on the outer periphery of the lead containing pipe 19 to extend radially outward, thus limiting a forward movement of the pipe 19. Additionally, a protective cap 103 which retains an eraser 29 has an outer periphery which is sized to be coincident with the outer periphery of the rear casing 14.

In operation, the feed roller 98 rotates as the rear casing 14 is rotated in the same manner as in the fourth and sixth embodiments. As the leading end of the lead 16 is engaged by the rear end of the feed roller 98, the latter moves forward until the front end of the front support shaft 100 bears against the bottom of the cavity 104. When such forward movement is interrupted, the feed roller 98 engages the lead 16. The rotation of the rear casing 14 is stopped when a desired length of the lead 16 is exposed through the front of the lead guide 15, whereby the pencil is in condition for writing. When the lead 16 is applied against a writing surface, the writing pressure imparts a force to the lead 16 which tends it to be retracted rearwardly. However, because the rib 99 on the feed roller 98 abuts against the peripheral surface of the lead 16 and the support shafts 100 of the feed roller 98 assume an inclined position such that the axis of the lead 16 is more closely approached as they are moved rearward, only a slight retraction of the feed roller 98 occurs to bite into the lead 16 as the latter also retracts slightly, in response to the writing pressure applied to the lead. The amount of such retraction is determined by a further bite of the rib 99 into the lead and the angle of the inclination of the shafts 100, but can be kept below 0.01 mm, and hence presents no difficulty for practical purposes. In this manner, a grip on the lead 16 is assured in accordance with the writing pressure.

While the feed roller 98 is formed as a reversing roller in the present embodiment, it may be designed to rotate in the forward direction by providing a helical rib thereon which is formed as a left-hand screw in the manner mentioned above in connection with the first embodiment. Alternatively, instead of movably disposing the support shafts on the front support plate, the axial movement of the feed roller may be achieved by providing an axially extending groove in the support shaft to permit a displacement of the feed roller along the groove.

Figure 12:
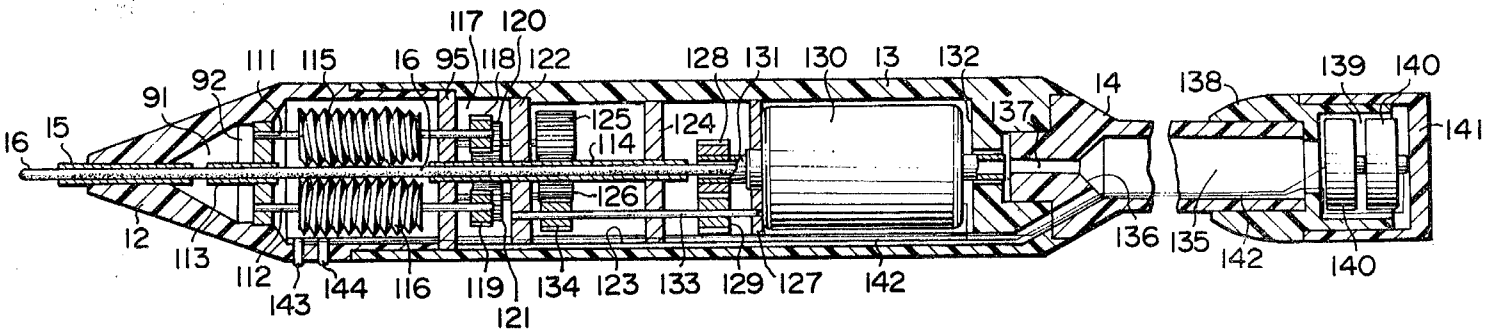
FIG. 12 is a longitudinal section, partly broken away, of an eighth embodiment of the invention.

FIG. 12 shows an eighth embodiment of the invention in which a motor is used to supply a rotating drive. As is the seventh embodiment, the front and the rear support plates 92, 95 are disposed within the front casing 12, and a pair of support shafts 111, 112, which are 180° spaced apart with respect to the axis of the lead 16, extend between and are rotatably mounted on the plates 92, 95. A lead support pipe 113 is mounted on the front support plate 92 in alignment with the axis of the lead guide 15. A lead feed pipe 114 which is disposed in alignment with the axis of the support pipe 113 has its one end supported by the rear support plate 95, and has its rear end extending through the intermediate casing 13. A feed roller 115 of the same construction as the feed roller 75 mentioned above in connection with the fourth embodiment is mounted on the support shaft 111 while a reversing roller 116 having a helical rib which is formed in the manner of a right-hand screw, and thus proceeds in the opposite direction from the feed roller 115, is mounted on the support shaft 116. The lead 16 which is delivered from the lead feed pipe 114 is fed into the lead support pipe 113 while it is being carried between the pair of rollers 115, 116.

The rear ends of the support shafts 111, 112 extend through the rear support plate 95 and project into a cavity 117 formed within the intermediate casing 13, with pinion gears 118, 119 being mounted on their free end. The gear 118 meshes with a reduction gear 120 which is disposed within the cavity 117 while the gear 119 meshes with a reduction gear 121. It is to be noted that the reduction gears 120 and 121 are maintained in meshing engagement with each other. Consequently, if the reduction gear 120 rotates clockwise, the gear 118 also rotates clockwise while the gear 119 rotates counter-clockwise. Hence, it will be appreciated that the feed roller 115 and the reversing roller 116 positively feed the lead 16 to the left, as viewed in FIG. 12, in the same manner as mentioned above in connection with the third embodiment. The reduction gears 120, 121 are rotatably supported in a partition 122 which is fitted into the rear end of the cavity 117 and which also supports the lead feed pipe 114 its central region. The rear surface of the partition 122 defines a front end of a cavity 123 which continues toward the rear end of the intermediate casing 13. The cavity 123 has a more reduced diameter than the cavity 117, whereby a rearward movement of the partition 122 is constrained. An abutment plate 124 is disposed within the cavity 123 at an axial spacing from the partition 122, and carries the rear end of the lead feed pipe 114. A second reduction gear 125 which is disposed in coaxial alignment with the reduction gear 120, and a third reduction gear 126 of a reduced diameter which meshes with the gear 125 are located intermediate the partition 122 and the abutment 124. A retainer plate 127 is disposed at an axial separation from the abutment plate 124, and a drive gear 128 and a drive reduction gear 129 which meshes therewith are located intermediate the abutment plate 124 and the retainer plate 127. The drive gear 128 is mounted on a drive shaft 131 of a motor 130, which is received in the cavity 123 between the retainer plate 127 and the rear end wall 132 of the intermediate casing 13. The drive shaft 131 comprises a hollow shaft with its axis aligned with the axis of the lead feed pipe 114. A miniature motor which can be fitted into the cavity 123 is desirably used for the motor 130, and is available from Namiki Seimitsu Hoseki K.K. In Japan as model 10CL-1200, for example. This motor has an outer diameter of about 10 mm and is of a coreless type. The rear end of the drive shaft 131 extends to the rear end of the intermediate casing 13. The drive reduction gear 129 is mounted on a shaft 133, the front end of which is rotatably supported by the partition 122 and the rear end of which is rotatably supported by the retainer plate 127. A transmission gear 134 is mounted on the front portion of the shaft 133 for transmitting the rotation of the shaft 133 to the third reduction gear 126.

The rear casing 14 is mounted on the rear end of the intermediate casing 13, and is formed with an axially extending lead-containing bore 135 therein. The front end of the bore 135 is formed into a front conical surface 136, and a lead passage 137 provides a communication between the front end of the conical surface 136 and the front end of the rear casing 14. In this manner, leads 16 contained in the bore 136 can be fed one by one into the hollow shaft 131 through the lead passage 137. A battery-containing sleeve 138 is detachably fitted over the rear end of the rear casing 14 so as to close the rear end of the bore 135. The sleeve 138 has a space 139 therein in which batteries 140 are received. A cap 141 is threadably engaged with the rear end of the sleeve 138, and the cap 141 can be unscrewed to enable a replacement of the batteries 140. It is to be noted that the batteries 140 are connected with miniature switches 143, 144 mounted in the wall of the front casing 12 as well as the motor 130 through lead wires 142. Switch 143 can be operated to rotate the motor 130 in the forward direction while the switch 144 can be operated to rotate the motor 130 in the reverse direction. These switches are formed by pushbutton switches of non-lock type, such switches are well known, for example the numerical or control switches mounted on the electronic wristwatch with an electronic calculator such as DPZ010 type which is commercially available from Kabushiki Kaisha Seikosha of Japan.

When the switch 143 is depressed with a finger, the motor 130 rotates in the forward direction. This rotation is transmitted through drive shaft 131, drive gear 128, and drive reduction gear 129 to the shaft 133, which then rotates in the opposite direction. The rotation of the shaft 133 is transmitted through the transmission gear 134, third reduction gear 126, and the second reduction gear 125 to rotate the reduction gear 120 in the forward or clockwise direction, thus causing a rotation of the feed roller 115 and the reversing roller 116 to feed the lead 16 to the left, as viewed in FIG. 12.

Figure 13:
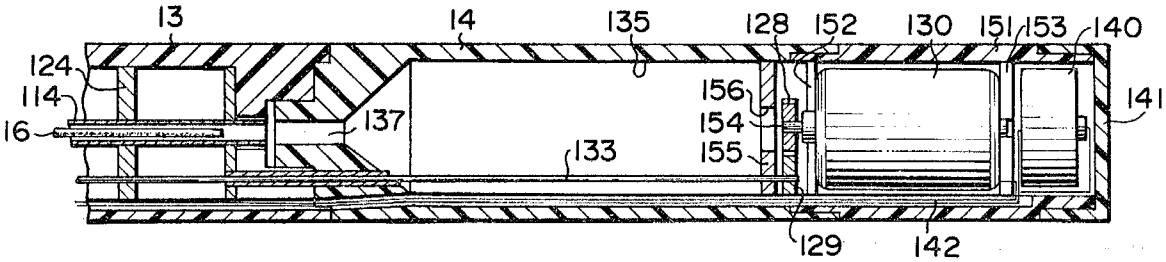
FIG. 13 is a longitudinal section of a drive transmission mechanism according to a ninth embodiment of the invention.

FIG. 13 shows a ninth embodiment of the invention, illustrating a modification of the drive transmission mechanism shown in FIG. 12. Specifically, the rear casing 14 is formed with only a lead containing bore 135, and a motor casing 151 which houses a motor 130 and a battery 140 is mounted on the rear end of the rear casing 14. The opposite ends of the motor 130 are fixed in position by retainer plates 152, 153, and the battery 140 is located on the opposite side of the retainer plate 153. The retainer plate 152 is centrally formed with an opening through which the drive shaft 154 of the motor 130 extends, and a drive gear 128 is mounted on the drive shaft 154 which projects through the retainer plate 153. A drive reduction gear 129 meshes with the drive gear 128, and is mounted on a shaft 133 which extends through a plate member 155 blocking the rear end of the lead containing bore 135 and which extends into the interior of the intermediate casing 13. The plate member 155 is centrally formed with an opening 156 through which leads 16 are inserted.

Figure 14:
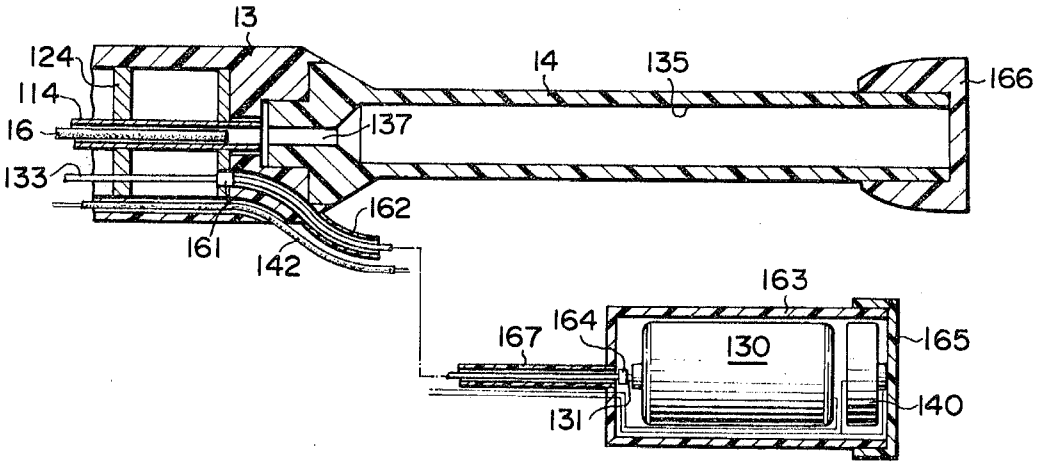
FIG. 14 is a longitudinal section of a drive transmission mechanism according to a tenth embodiment of the invention.

FIG. 14 shows a tenth embodiment of the invention in which a motor and a power supply are separately provided. Specifically, a flexible shaft 162 is connected with the rear end of the shaft 133 through a sleeve coupling 161. The flexible shaft 162 extends from the rear part of the intermediate casing 13 to the exterior thereof. The other end of the flexible shaft 162 is connected with the drive shaft 154 of the motor 130, housed within a separate motor casing 163, through a sleeve coupling 164. The motor casing 163 houses the motor 130 and the battery 140, and a cap 165 is detachably mounted on the end of the motor casing which is nearer the battery 140. In the present embodiment, it is only necessary that the rear casing 14 be formed with the lead containing bore 135, with a lead cap 166 detachably fitted over the rear end of the rear casing 14 to close the lead containing bore 135. The flexible cable 162 is provided with a protective tube 167.

In the eighth to tenth embodiments described above, it is possible to feed the lead 16 about 0.4 mm forward by one touch of the switch 143 when the motor 130 has a number of revolutions of 2,000 rpm, the transmission gearing has a speed reduction ratio of 1/75, and the feed roller 115 and the reversing roller 116 have a pitch of 0.4 mm.

FIGS. 15 and 16 show an eleventh embodiment of the invention in which the lead is fed forward by interrupting the writing process and the tip of the mechanical pencil is moved away from a writing surface to release the writing pressure.

Specifically referring to these Figures, the mechanical pencil comprises a casing body 171 which includes a front casing 172, and a rear casing 173 which has its front end threadably engaged into the rear end of the front casing 172. The rear casing 173 is internally formed with a lead-containing bore 174, the forward of which is shaped into a front conical surface 175 which is centrally formed with an opening.

The forward portion of the front casing 172 is shaped into a tapered ferrule 176 defining a space 177 which continues to the rear end of the front casing 172. At its tip, the ferrule 176 is centrally formed with a through-opening 178 in which a lead guide 179 is slidably disposed for supporting a lead 16 in a slidable manner. The lead guide 179 has a sufficient length such that its front end projects through the ferrule 176 while its rear end extends into the space 177. A spring abutment 181 having an opening 180 formed therein which communicates with the hollow interior of the lead guide 179 is mounted on the rear end thereof. Fitted into the space 177 and secured therein is a cylindrical body 184 which has its opposite ends closed by sideplates 182, 183. A coiled spring 185 is mounted between the spring abutment 181 and the sideplate 182 for normally urging the lead guide 179 outward, namely, to the left as viewed in FIG. 16. A lead feed pipe 186 having its axis aligned with the axis of the lead guide 179 is passed through openings formed in the both sideplates 182, 183 so as to be supported thereby. A pair of axially extending notches 187, 188 are formed in the peripheral wall of the lead feed pipe 186 and are spaced apart 180° around the axis thereof, thereby exposing the lead 16. The rear end of the lead feed pipe 186 extends into the central opening formed in the front conical surface 175. In this manner, a lead from the lead-containing bore 174 can be delivered through the lead feed pipe 186 and fed forward from the front end of the lead guide 179. A first feed roller 189 is located adjacent to the notch 187 while a second feed roller 190 is located adjacent to the notch 188. These rollers 189, 190 are constructed in the same manner as the rollers 36, 55 described above in connection with the second embodiment. In a region between the sideplate 183 and the notches 187, 188, a pair of L-shaped support plates 191 are mounted on the lead feed pipe 186 such that one of their limbs extend parallel to the plane of the sideplate 183. The pair of rollers 189, 190 are mounted on support shafts 192, 193, respectively, the opposite ends of which are rotatably supported by the sideplate 182 and the support plates 191. The end of the respective support shafts 192, 193 which is located nearer the support plates 191 extends therethrough, with transmission rollers 194, 195 mounted on the free end thereof.

A rotating cylinder 196 is fitted inside the cylindrical body 184 with a very small clearance therebetween. To assure a smooth rotation of the cylinder 196, ball bearings 197 are interposed between the cylindrical body 184 and the cylinder 196 at a suitable interval. The rear end of the cylinder 196 is located rearwardly of a surface of the support plates 191 which supports the support shafts 192, 193, and is internally formed with an annular projection 198. The cylinder 196 is internally formed with a helical groove 199 across its length, and a rotating roller 200 fits in the groove 199. The roller 200 is rotatably mounted on one end of a connecting bar 201, the other end of which extends through an opening 202 formed in the sideplate 182 to be connected with the spring abutment 181. The opening 202 has a diameter which is slightly greater than the outer diameter of the connecting bar 201 so as to permit only a vertical movement of the connecting bar 201. Consequently, if the lead guide 179 is brought into abutment against a writing surface P and is raised, the connecting bar 201 is also raised, whereby the roller 200 moves along the groove 199. However, the opening 202 prevents the connecting bar 201 from rotating. As a consequence, the upward movement of the connecting bar 201 imparts a rotating force to the cylinder 196.

A hollow, rotation transmitting cylinder 203 is fitted into the rear end of the cylinder 196. It comprises a detent flange 204 of a diameter which is less than the internal diameter of the cylinder 196, but is greater than the internal diameter of the annular projection 198, a cylindrical portion 205 of a diameter which is slightly less than the internal diameter of the annular projection 198, and a cylindrical engaging portion 206 having an outer diameter which is less than the outer diameter of the cylindrical portion 205, all connected together in an integral manner. A downward movement, as viewed in FIG. 15, of the detent flange 204 is limited by abutment against the support plates 191 while its upward movement is limited by abutment against the annular projection 198. The internal surface of the cylindrical portion 205 is maintained in engagement with transmission rollers 194, 195, whereby the rotation of the hollow cylinder 203 causes the transmission rollers 194, 195 to rotate. The outer periphery of the engaging portion 206 is maintained in engagement with a plurality of auxiliary rollers 207 which are rotatably mounted on the sideplate 183. The purpose of these auxiliary rollers 207 is to assure a smooth rotation of the hollow cylinder 203. The opposing surfaces of the annular projection 198 and the detent flange 204 are formed to exhibit a high coefficient of friction so that when they are held in abutment, the rotation of the cylinder 196 is positively transmitted to the cylinder 203. By way of example, these surfaces may be lined with rubber or threaded.

When the lead guide 179 is brought into abutment against the writing surface P to be raised upward, the rotating roller 200 functions to push up the lower end of the groove 199, so that a clearance is formed between the annular projection 198 and the detent flange 204. Hence, a rotation of the cylinder 196 does not cause a rotation of the hollow cylinder 203. When the tip of the lead guide 179 is released from the writing surface, the resilience of the spring 185 urges the spring abutment 181 downward. As the abutment 181 is pushed back, the roller 200 moves downward along the groove 199 while maintaining its engagement with a lower region of the groove 199. This movement imparts an opposite rotation to the cylinder 196. On the other hand, when the rotating roller 200 engages the lower end of the groove 199 and the cylinder 196 is urged to move downward, the detent flange 204 is brought into contact with the annular projection 198, whereby the rotation of the cylinder 196 is transmitted to the hollow cylinder 203, thus rotating it. In response thereto, the transmission rollers 194, 195 rotate in the same directions, causing the first and second feed rollers 189, 190 to rotate. The rotation of the rollers 189, 190 feeds the lead 16 forward as mentioned above in connection with the second embodiment. The rollers 189, 190 continue to rotate until the spring abutment 181 abuts against the front wall which defines the space 177. In this manner, with this embodiment, the arrangement that the lead guide 176 is axially movable permits the writing process to be continued while raising the lead guide 176. When the lead guide 176 is released from the writing surface P after it is raised through a certain stroke, the lead 16 is automatically fed forward.

Figure 17:
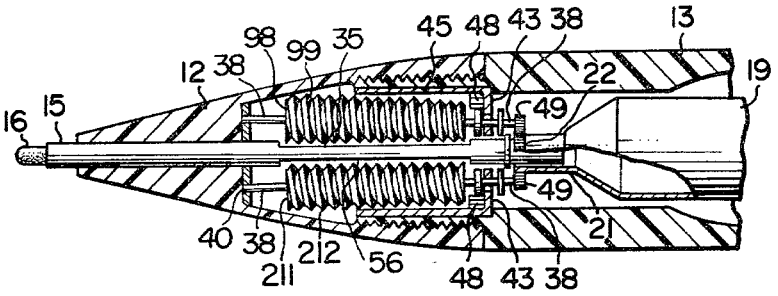
FIG. 17 is a longitudinal section of a lead feed mechanism according to a twelfth embodiment of the invention.

FIG. 17 shows a twelfth embodiment of the invention in which the two feed rollers 36, 55 of the second embodiment are replaced by the feed roller 98 of the seventh embodiment respectively. A second feed roller 211 is disposed parallel to the feed roller 98 at an angular position which is 180° spaced from the feed roller 98 relative to the axis of the lead guide 15. A helical rib 212 is formed on the periphery of the second feed roller 211 in the manner of a left-hand screw in the same manner as the feed roller 98. The support of and rotation transmission for the second feed roller 211 are similar to those described above in connection with the second embodiment. By this arrangement, the grip on the lead 16 as well as the force to feed the lead 16 by the rollers 98, 211 can be increased, and further the grip on the lead can be varied in accordance with the magnitude of the writing pressure.

Figure 18:
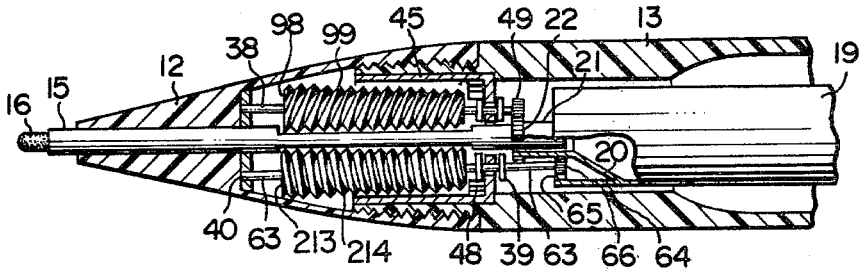
FIG. 18 is a longitudinal section of a lead feed mechanism according to a thirteenth embodiment of the invention.

In an embodiment shown in FIG. 18, the second feed roller 211 of the twelfth embodiment is replaced by a reversing roller 213 having a helical rib 214 which proceeds in the opposite direction from the helical rib 99 on the feed roller 98. The support of and rotation transmission for the reversing roller 213 are similar to those described above in connection with the second embodiment shown in FIG. 4.

Figure 19:
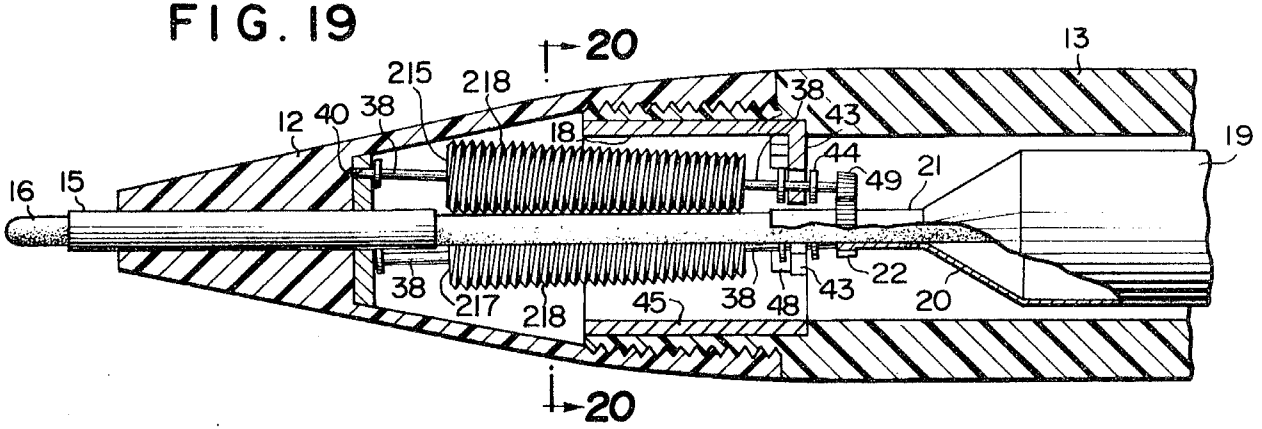
FIG. 19 is a longitudinal section of a lead feed mechanism according to a fourteenth embodiment of the invention.
Figure 20:
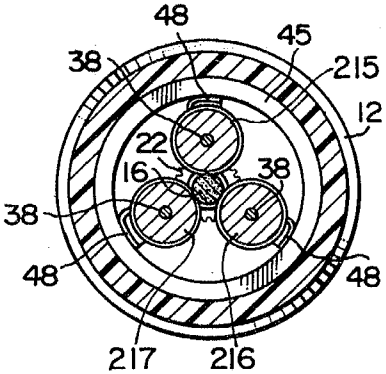
FIG. 20 is a transverse section taken along the line 20—20 showing in FIG. 19.

FIGS. 19 and 20 show a fourteenth embodiment in which three feed rollers are employed to feed a lead forward. Specifically, three feed rollers 215, 216, 217, each of which is constructed in the same manner as the feed roller 98 shown in the seventh embodiment, are spaced apart at an equal interval of 120° about the axis of the cavity 18 formed in the intermediate casing 13 so as to surround the lead 16. A helical rib 218 formed on each roller proceeds in the same direction, that is, is formed as a left-hand screw. The manner in which the individual rollers 215, 216, 217 are supported, and the transmission mechanism by which a rotating drive is transmitted thereto, are the same as those mentioned above in connection with the fifth embodiment.

Figure 21:
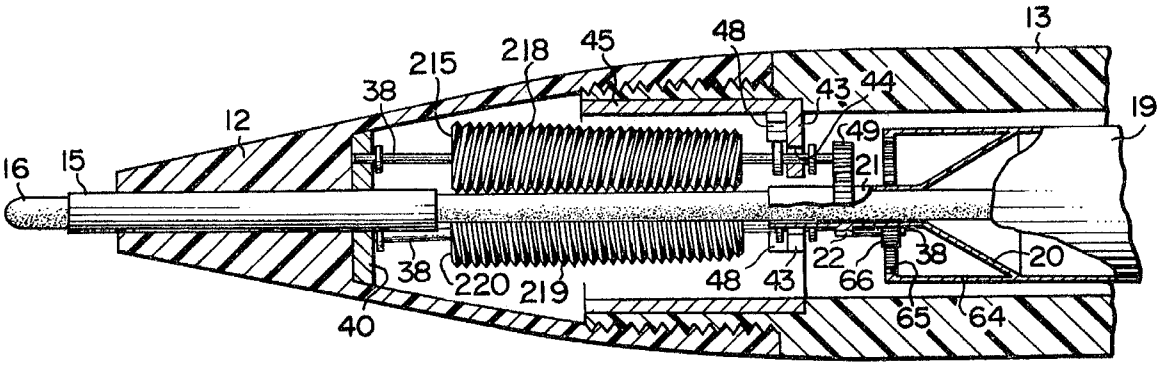
FIG. 21 is a longitudinal section of a lead feed mechanism according to a fifteenth embodiment of the invention.

FIG. 21 shows a fifteenth embodiment of the invention where one of the three feed rollers shown in the fourteenth embodiment is replaced by a reversing roller which has been described above in connection with the thirteenth embodiment. Specifically, the feed roller 217 of the fourteenth embodiment is replaced by a reversing roller 220 having a helical rib 219 which proceeds in the opposite direction from that of the other feed rollers. The configuration of the reversing roller 220 and mechanism which transmits rotation thereto are constructed the same as the reversing roller 62 described above.

Figure 22:
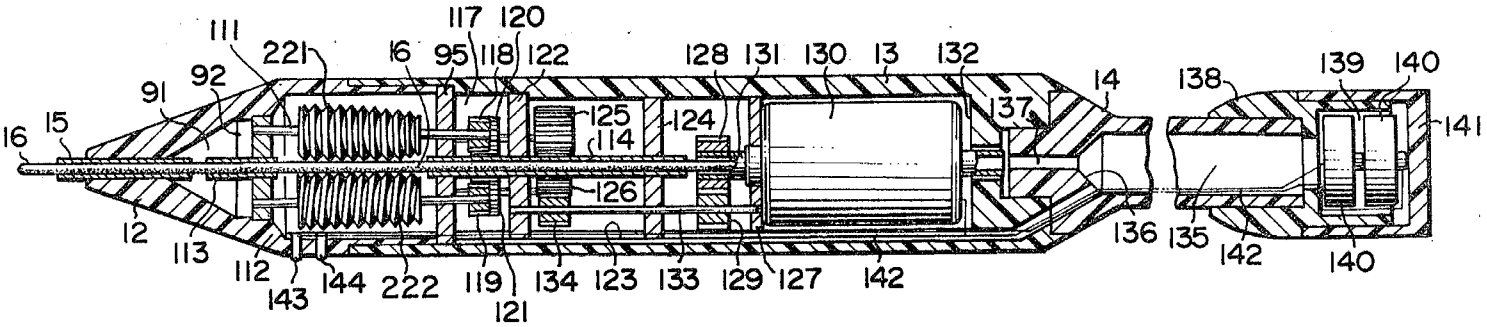
FIG. 22 is a longitudinal section of a lead feed mechanism according to a sixteenth embodiment of the invention.

FIG. 22 shows a sixteenth embodiment in which the rollers 115, 116 of the eighth embodiment are replaced by rollers 221, 222 similar to the rollers 98 and 213 shown in FIG. 18. The support of and a rotation transmission for the rollers 221, 222 are similar to those described above in connection with the eighth embodiment, and hence will not be described specifically.

What is claimed is:

1. A mechanical pencil comprising: a casing having a ferrule at its one end and having a central bore which extends axially thereof; a lead-containing sleeve capable of containing a plurality of leads and fitted into the central bore and having its rear end closed by a cover which is detachably mounted on the casing, the front end of the sleeve having a narrowed portion having an opening in alignment with the sleeve axis and a diameter slightly greater than that of the lead; a lead guide pipe mounted in the ferrule so as to be aligned with the axis of the central bore and slidably holding the lead; lead feed means located intermediate the lead guide pipe and the lead-containing sleeve and including at least one lead feed roller having a helical rib on its periphery for engagement with the outer peripheral surface of the lead, said feed roller having a frusto-conical configuration with its axis located in a plane which includes the axis of the lead guide and which is disposed at an angle with respect to the axis of the lead guide, the feed roller being supported so as to be slidable in its axial direction; drive means for rotating the lead feed roller about its axis; and operating means mounted on the outside of the casing for operating the drive means.

2. A mechanical pencil according to claim 1 in which the lead feed means includes two feed rollers with the helical rib on the one feed roller proceeding in the opposite direction from the helical rib on the other feed roller; and said drive means includes means for rotating the two feed rollers in opposite directions.

3. A mechanical pencil according to claim 1 in which said lead feed means comprises a first, a second and a third roller which are spaced apart approximately 120° about the axis of the central bore so as to surround the lead; and wherein said drive means includes means for simultaneously rotating the three feed rollers about their respective axes.

4. A mechanical pencil according to claim 3 in which the helical ribs on the first, the second and the third feed roller proceed in the same direction; and said drive means includes means for rotating all the feed rollers in the same direction.

5. A mechanical pencil according to claim 3 in which the helical rib on the first feed roller proceeds in the opposite direction from the helical ribs on the second and the third feed roller; and said drive means includes means for rotating the first feed roller in the opposite direction from the second and the third feed roller.

6. A mechanical pencil according to claim 1 in which the feed roller has a tapered portion at its end which is located nearer the lead-containing sleeve, the tapered portion having a diameter which gradually reduces toward the lead-containing sleeve.

7. A mechanical pencil according to claim 11 in which the rear end of the lead guide pipe is fitted into a portion of the lead-containing sleeve which has a reduced diameter, the lead guide pipe being formed with a notch in its peripheral surface in a region adjacent to the feed roller, the notch extending axially of the feed roller to enable the feed roller to engage with the lead in the region of the notch.

8. A mechanical pencil according to claim 1 in which said operating means comprises a cylindrical member which is mounted on the rear end of a casing so as to be rotatable about the axis of the central bore, the rear end of the lead-containing sleeve being firmly connected with the cylindrical member such that rotation of the cylindrical member is effective to rotate the lead-containing sleeve thereby operating the drive means.

9. A mechanical pencil according to claim 8 in which said drive means comprises annular rack teeth formed around the circumference of the lead-containing sleeve at its front end, and a drive gear mounted on the shaft of the feed roller and meshing with the rack teeth.

10. A mechanical pencil according to claim 1 in which said drive means comprises a power supply, an electric motor driven by the supply, and a reduction gearing located within the casing and transmitting the rotation of the motor to the lead feed means; said operating means comprising switch means for controlling rotation of the motor in the forward or reverse direction.

11. A mechanical pencil according to claim 10 in which the supply and the motor are received in a housing which is detachably fitted on the rear end of the casing.

12. A mechanical pencil according to claim 10 in which the supply and the motor are received in an external casing, and the drive shaft of the motor and the reduction gearing are connected together through a flexible shaft.

13. A mechanical pencil according to claim 1 in which said drive means comprises a power supply, an electric motor driven by the supply, and a reduction gear mechanism which transmits the rotation of the motor to the lead feed means; said operating means comprising switch means for controlling rotation of the motor in the forward or reverse direction, the motor being located within the casing between the lead feed means and the lead-containing sleeve, the motor having a hollow drive shaft through which a lead from the lead-containing sleeve is fed to the lead feed means.

* * * * *